US010184653B2

(12) United States Patent
Bukkems et al.

(10) Patent No.: US 10,184,653 B2
(45) Date of Patent: Jan. 22, 2019

(54) RETROFIT LIGHT BULB

(71) Applicant: PHILIPS LIGHTING HOLDING B.V., Eindhoven (NL)

(72) Inventors: Peter Johannes Martinus Bukkems, Eindhoven (NL); Aldegonda Lucia Weijers, Eindhoven (NL); Johannes Petrus Maria Ansems, Eindhoven (NL); Peter Rijskamp, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 2 days.

(21) Appl. No.: 15/553,244

(22) PCT Filed: Feb. 26, 2016

(86) PCT No.: PCT/EP2016/054046
§ 371 (c)(1),
(2) Date: Aug. 24, 2017

(87) PCT Pub. No.: WO2016/135276
PCT Pub. Date: Sep. 1, 2016

(65) Prior Publication Data

US 2018/0031225 A1 Feb. 1, 2018

(30) Foreign Application Priority Data

Feb. 26, 2015 (EP) ..... 15156766

(51) Int. Cl.
*F21V 29/70* (2015.01)
*F21K 9/90* (2016.01)
(Continued)

(52) U.S. Cl.
CPC ..... *F21V 29/70* (2015.01); *F21K 9/232* (2016.08); *F21K 9/238* (2016.08); *F21K 9/62* (2016.08);
(Continued)

(58) Field of Classification Search
CPC ..... F21V 29/70; F21V 7/0008; F21V 19/003; F21V 23/006; F21K 9/62; F21K 9/238; F21K 9/90
(Continued)

(56) References Cited

U.S. PATENT DOCUMENTS

2013/0063935 A1* 3/2013 Thrailkill ..... F21V 29/004 362/231
2013/0250587 A1* 9/2013 Kim ..... F21V 21/00 362/373

FOREIGN PATENT DOCUMENTS

WO WO2010136985 A1 12/2010
WO WO2011107925 A1 9/2011
WO WO2014087366 A1 6/2014

* cited by examiner

*Primary Examiner* — Paultep Savusdiphol
(74) *Attorney, Agent, or Firm* — Akarsh P. Belagodu

(57) ABSTRACT

A retrofit light bulb (1) is disclosed. The retrofit light bulb (1) comprises a substantially flat heat spreader (2) having an opening (5); first and second cover members (7, 8) sandwiching the heat spreader (2), each cover member (7, 8) having a protruding portion (9, 10) directed away from the heat spreader (2) and aligned with the opening (5), the two protruding portion (9, 10) together forming a compartment (11); and one or more solid state lighting devices (18) mounted on a carrier (19) arranged in said compartment (11), in thermal contact with the heat spreader (2), wherein said one or more solid state lighting devices (18) are arranged so that each protruding portion (9, 10) receives light directly from each solid state lighting device (18). The compartment thus forms a single light mixing chamber in which light emitted by all of the SSL devices is mixed.

11 Claims, 2 Drawing Sheets

(51) Int. Cl.

| | |
|---|---|
| ***F21V 7/00*** | (2006.01) |
| ***F21V 23/00*** | (2015.01) |
| ***F21K 9/232*** | (2016.01) |
| ***F21K 9/62*** | (2016.01) |
| ***F21K 9/238*** | (2016.01) |
| ***F21V 19/00*** | (2006.01) |
| *F21Y 115/10* | (2016.01) |
| *F21Y 113/13* | (2016.01) |

(52) U.S. Cl.
CPC ..... *F21K 9/90* (2013.01); *F21V 7/0008* (2013.01); *F21V 19/003* (2013.01); *F21V 23/006* (2013.01); *F21Y 2113/13* (2016.08); *F21Y 2115/10* (2016.08)

(58) Field of Classification Search
USPC ..... 362/612, 311.02
See application file for complete search history.

RETROFIT LIGHT BULB

CROSS-REFERENCE TO PRIOR APPLICATIONS

This application is the U.S. National Phase application under 35 U.S.C. § 371 of International Application No. PCT/EP2016/054046, filed on Feb. 26, 2016, which claims the benefit of European Patent Application No. 15156766.6, filed on Feb. 26, 2015. These applications are hereby incorporated by reference herein.

TECHNICAL FIELD

The present invention relates to a retrofit light bulb, more precisely to a retrofit light bulb having solid state lighting (SSL) devices.

BACKGROUND

WO 2014/087366 A1 discloses a lighting device that comprises a light emitting portion with at least two solid state light sources. The light emitting portion includes a first and a second cover member, each having a light source carrier and a light transmitting portion. The two light sources carriers are coplanar. The light sources of different light source carriers emit light in opposite directions and are equal in number for a uniform distribution of light around the lighting device.

It is desirable that retrofit light bulbs, such as the one described above, be inexpensive to produce and meet high technical performance standards. Existing retrofit light bulbs can be improved in these respects.

US 2013/0250587 A1 discloses a LED lamp with a housing formed of a pair of housing members connected to each other in a horizontal direction, that is with a vertical connection line. The LEDs are mounted on a carrier in a horizontal plane, which carrier is kept in position by the housing members and heat is radiated form the carrier in upwards and downwards direction.

SUMMARY

It would be advantageous to provide an improved or alternative retrofit light bulb that is inexpensive to produce and meets high technical performance standards.

To better address these concerns, in a first aspect of the invention there is presented a retrofit light bulb that comprises a substantially flat heat spreader with an opening; first and second cover members sandwiching the heat spreader, each cover member having a protruding portion directed away from the heat spreader and aligned with the opening, the two protruding portions together forming a compartment; and one or more SSL devices mounted on a carrier arranged in said compartment, in thermal contact with the heat spreader. The one or more SSL devices are arranged so that each protruding portion receives light directly from each SSL device.

By "substantially flat" is meant that the heat spreader may comprise relatively small portions, such as depressions, protrusions or similar, that depart from the mainly flat shape of the heat spreader. By "in thermal contact" is meant that heat can be transferred from the carrier to the heat spreader through thermal conduction. By a protruding portion receiving light "directly" from an SSL device is meant that the protruding portion is the first surface that the emitted light strikes after leaving the SSL device.

The light bulb described above does not need to have an even number of SSL devices for the light distribution to be symmetric, something which makes it possible to use the lowest number of SSL devices necessary for a particular application. This reduces production costs, the total cost of the SSL devices of light bulbs with only a few SSL devices, which are becoming more and more common, being affected to a particularly large degree.

Moreover, the compartment forms a single light mixing chamber in which light emitted by all of the SSL devices is mixed. Having the light from all of the SSL devices mix in the same light mixing chamber may reduce binning requirements for the SSL devices (and thus costs). It may also enable a particularly efficient mixing of light from SSL devices of different colors while keeping the total cost of the SSL devices low.

The retrofit light bulb may also have fewer electrical connections than many other similar light bulbs. For example, light bulbs having SSL devices mounted on two sides of a carrier typically require there to be connections through the carrier which are costly to provide. Light bulbs with several carriers, for example two carriers mounted on a respective side of a heat spreader, are another example of light bulbs usually requiring more connections and wires than the retrofit light bulb according to the present invention. Fewer electrical connections typically means a simpler manufacturing process and lower costs associated therewith.

According to one embodiment, the opening contains an optical center of the retrofit light bulb. The location of the optical center for a particular type of light bulb is given by industry standards, such as those of the American National Standard Lighting Group, and positioning the opening in this way may facilitate compliance with certain industry standards. Usually, the optical center of a light bulb is located close to its geometrical center.

According to one embodiment, each protruding portion has a cross section, which is parallel to the heat spreader and the size of which is larger than or equal to the opening.

According to one embodiment, the first and second cover members have substantially the same shape. Such cover members are suitable for applications requiring a highly symmetric light distribution. It may also reduce the numbers of tools needed in the manufacturing process as in some cases the same tools may be used for forming both cover members.

According to one embodiment, each cover member has a flat portion at least partially surrounding the protruding portion. Such cover members can be slim, thereby reducing the size of the retrofit light bulb. Also, heat can be transferred effectively between such cover members and the flat heat spreader because their area of contact may be relatively large.

According to one embodiment, the retrofit light bulb comprises a mechanical and electrical connector arranged by an end of the retrofit light bulb. Each SSL device may be arranged to emit light in a direction away from the connector. The connector can be made to fit in standard light bulb sockets, making it straightforward to use the retrofit light bulb in lamps, luminaries, etc., originally intended for traditional incandescent light bulbs.

According to one embodiment, the protruding portions extend beyond the opening in a direction towards the connector.

According to one embodiment, an end of each protruding portion is provided with a reflector, the end being distal to the connector. The reflectors facilitate the meeting of the light distribution requirements of some technical performance standards, such as "Energy Star", in particular when the retrofit light bulb has only a small number of SSL devices.

According to one embodiment, the retrofit light bulb comprises drive circuitry arranged on a driver board which is arranged coplanar with the heat spreader, the carrier being mechanically and electrically connected to the driver board by a connection member. Arranging the driver in this way can make the light bulb compact and slim.

It is noted that the invention relates to all possible combinations of features recited in the claims.

BRIEF DESCRIPTION OF THE DRAWINGS

The present invention will now be described in more detail, with reference to the appended drawings in which.

As illustrated in the figures, the sizes of layers and regions are exaggerated for illustrative purposes and, thus, are provided to illustrate the general structures of embodiments of the present invention.

DETAILED DESCRIPTION

Currently preferred embodiments of the present invention will now be described more fully hereinafter with reference to the accompanying drawings. This invention may, however, be embodied in many different forms and should not be construed as limited to the embodiments set forth herein; rather, these embodiments are provided for thoroughness and completeness, and fully convey the scope of the invention to the skilled person.

Figure 1:
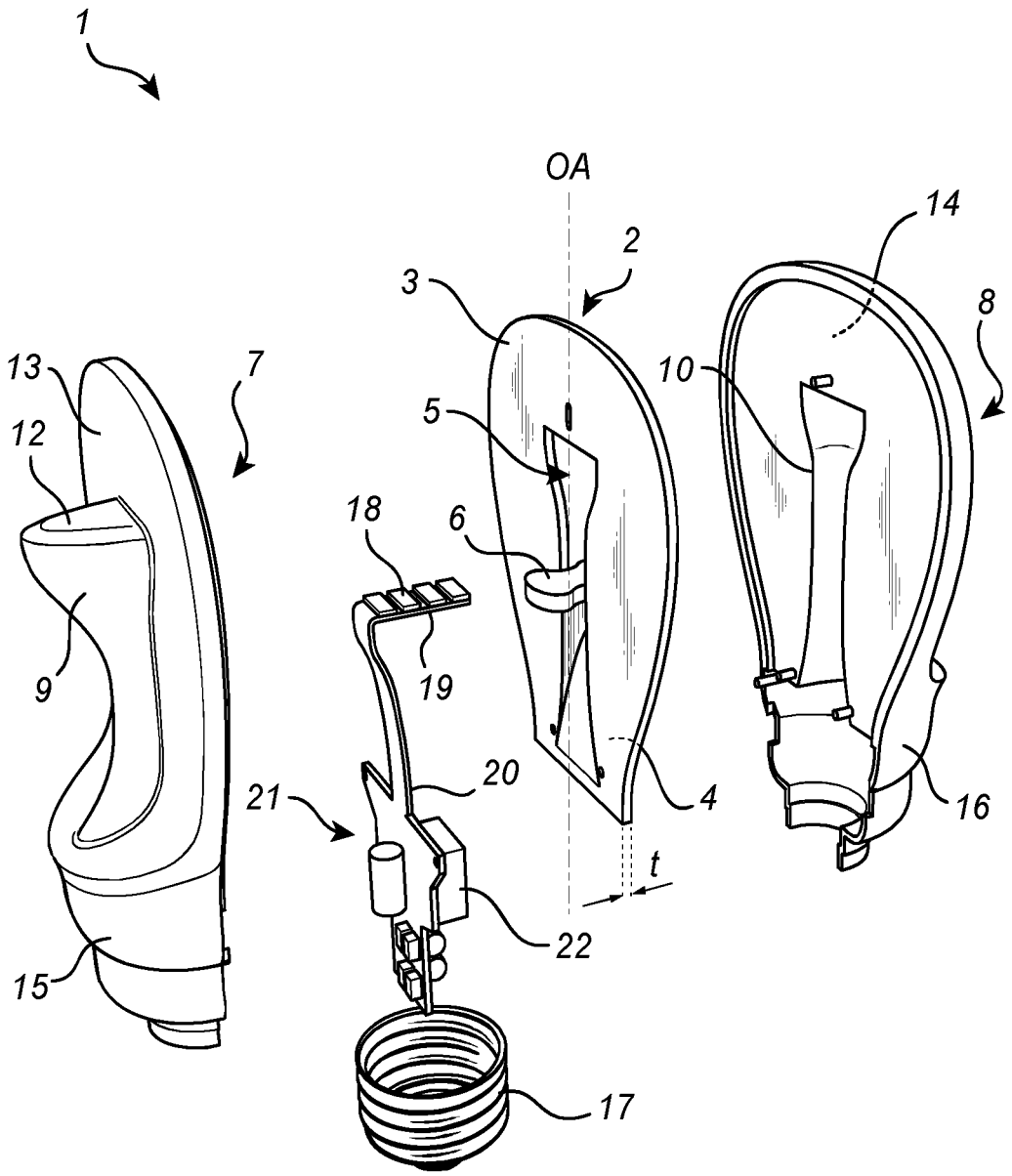
FIG. 1 shows a schematic exploded view in perspective of an embodiment of a retrofit light bulb.
Figure 2:
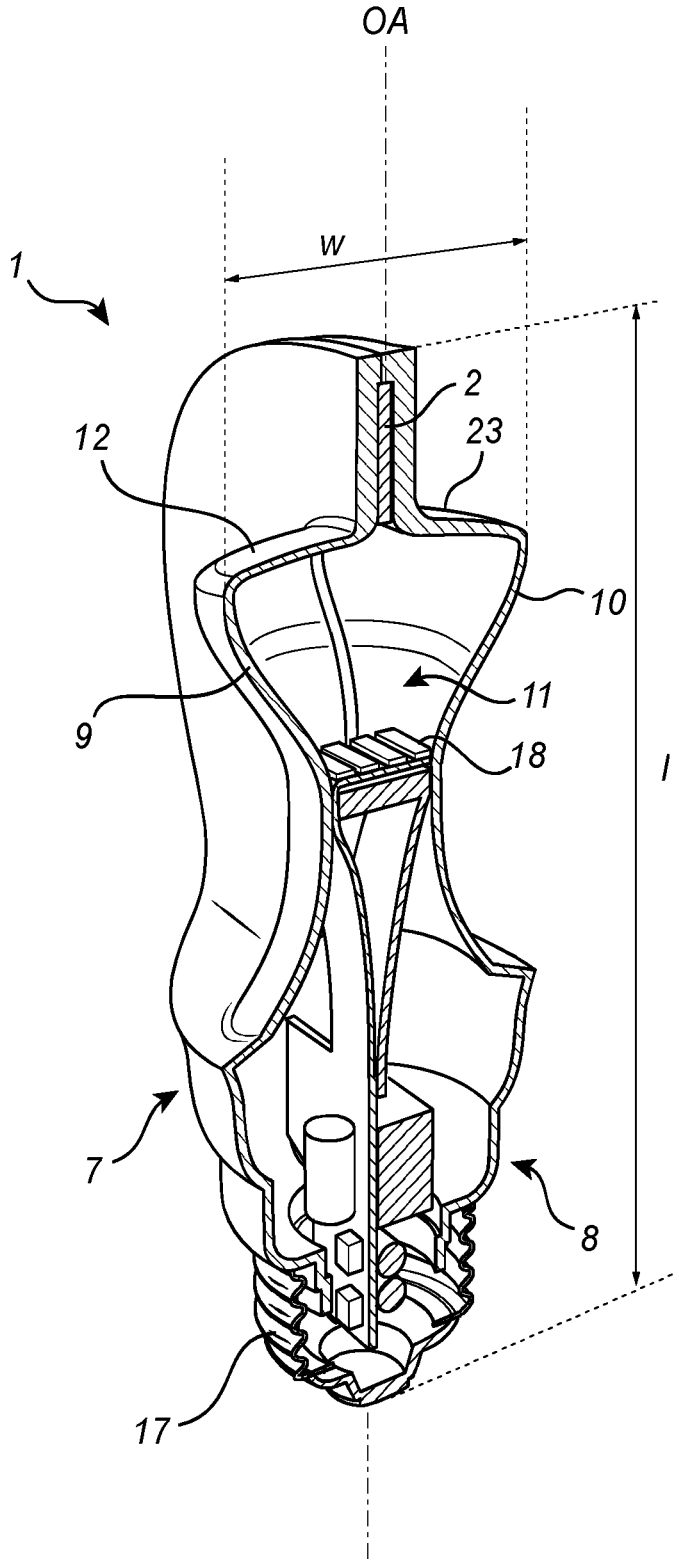
FIG. 2 shows a schematic cross sectional view in perspective of the retrofit light bulb in FIG. 1.

FIGS. 1 and 2 show a retrofit light bulb 1, for example an A21 or A60 retrofit light bulb. The retrofit light bulb 1 has an optical axis OA which is a central axis of the retrofit light bulb 1. The distribution of light emitted by the retrofit light bulb 1 is approximately rotationally symmetric around the optical axis OA. The length l of the retrofit light bulb 1 along the optical axis OA may for example be somewhere between 60 mm and 350 mm. A substantially flat heat spreader 2 is arranged along the optical axis OA. The thickness t of the heat spreader 2 depends on the thermal performance required by the intended application, but, typically, the thickness t is in the range from 0.5 mm to 2 mm. The heat spreader 2 can be produced by deep drawing and as a single piece. Examples of materials which the heat spreader 2 can be made of include aluminum, aluminum alloys, aluminum oxides, copper, copper alloys, magnesium, zinc, iron, steel, graphite compressed flakes, pyrolytic graphite and thermally conductive plastics with a high graphite content.

The heat spreader 2 has a first and a second side surface 3, 4 which are flat and parallel to each other. The surface normal of the first side surface 3 is perpendicular to the optical axis OA, and the same is true for the surface normal of the second side surface 4. The heat spreader 2 has an opening 5 which is centrally positioned in the first and second side surfaces 3, 4 and extends therebetween. When viewed along the surface normal of the first or second side surface 3, 4, the optical axis OA splits the opening 5 in two symmetric halves. The opening 5 has a tapered and curved shape, but other shapes are possible such as circular and elliptical shapes. The opening 5 contains the optical center of the retrofit light bulb 1, something which may or may not be the case in other embodiments. A supporting surface 6 is positioned in the opening 5. The supporting surface 6 is formed in one piece with the heat spreader 2. In other embodiments, the supporting surface 6 may be part of a piece that has been attached to the heat spreader 2. The supporting surface 6 is flat, extends through the opening 5 and projects outwards on both sides of the heat spreader 2, thus departing from the substantially flat shape of the heat spreader 2. The surface normal of the supporting surface 6 is parallel with the optical axis OA. The optical axis OA runs through a center point of the supporting surface 6.

The heat spreader 2 is sandwiched between a first cover member 7 and a second cover member 8, the first cover member 7 facing the first side surface 3 and the second cover member 8 facing the second side surface 4. The first and second cover members 7, 8 are at least partly made of a light transmissive material. Injection molding can for example be used for producing the first and second cover members 7, 8. Examples of materials which the first and second cover members 7, 8 can be made of include PC, PMMA, PET and SAN. The first and second cover members 7, 8 have substantially the same shape and are arranged mirror symmetrically with respect to the plane of the heat spreader 2. The first and second cover members 7, 8 may be provided with complementary indentations, protrusions, slits, edges, or the like, that allow them to be attached to each other.

Each cover member 7, 8 is provided with a protruding portion 9, 10 directed away from the heat spreader 2. It follows that the protruding portion 9 of the first cover member 7 and the protruding portion 10 of the second cover member 8 are directed in opposite directions. The protruding portions 9, 10 have the same shape. The size of the cross sections of the protruding portions 9, 10 is larger than the opening 5, the cross sections being along the optical axis OA and parallel with the heat spreader 2. In other embodiments, the size of the cross sections may be equal to or smaller than the opening 5. The protruding portions 9, 10 extend beyond the opening 5 in the direction towards the connector 17 (further discussed below). Together, the two protruding portions 9, 10 form a compartment 11. The maximum width w of the compartment 11 (measured perpendicular to the optical axis OA) differs between applications, the width w depending on, for example, the desired light distribution and the number of SSL devices 18 (further described below). In some applications, a suitable value of the width w may be somewhere in the range from 5 mm to 50 mm. Any portions of the heat spreader 2 that are exposed from the inside the compartment 11 may be covered by a reflective material for reasons of optical efficiency.

The protruding portions 9, 10 are provided with a respective reflector 12, 23 which may or may not be included in other embodiments. The reflectors 12, 23 are arranged on the ends of the protruding portions 9, 10 that are distal to the connector 17 (further described below). The locations of the reflectors 12, 23 are such that light emitted by the SSL devices 18 (further described below) is received by the reflectors 12, 23. The reflectors 12, 23 may be formed in one piece with the protruding portions 9, 10 or attached to the protruding portions 9, 10. The reflectors 12, 23 can be partly light transmissive or configured to be totally reflective. The reflection of light by the reflectors 12, 23 can be specular or diffuse. The reflectors 12, 23 can be made of a plastic material, such as reflective PC, or a metal, such as aluminum. The reflectors 12, 23 may be formed by a coating, for example a white coating or a dichroic coating. The reflectors 12, 13 may be formed by translucent portions of the protruding portions 9, 10 with high back scattering values.

Each cover member 7, 8 has a flat portion 13, 14 that at least partially surrounds the protruding portion 9, 10 of the corresponding cover member 7, 8. The flat portions 13, 14 are arranged parallel to the heat spreader 2. The heat spreader 2 and the flat portions 13, 14 are in thermal contact with each other, and this can be achieved in several ways. The flat portions 13, 14 and the heat spreader 2 may for example be in direct physical contact with each other, or a thermal interface material may be arranged between the flat portions 13, 14 and the heat spreader 2 so that the flat portions 13, 14 and the heat spreader 2 are in indirect physical contact. Such a thermal interface material may be a layer of glue for attaching the flat portions 13, 14 to the heat spreader 2. Another possibility is that there is an air layer between the flat portions 13, 14 and the heat spreader 2. The thickness of the air layer should be approximately 0.2 mm or less in order for the air layer not to be thermally insulating.

The first and second cover members 7, 8 have a respective lower portion 15, 16. Each of the lower portions 15, 16 is semi circular, and together the lower portions 15, 16 form a tubular neck which is insertable, along a direction of the optical axis OA, into a mechanical and electrical connector 17 in the form of a threaded cap. The connector 17 is arranged by an end of the retrofit light bulb 1 and adapted to be connected to an electrical socket. The connector 17 can for example be made of a metal, such as aluminum, brass or nickel, or a combination of plastic materials and metals.

The retrofit light bulb 1 has several SSL devices 18 arranged in the compartment 11. Other embodiments may have a single SSL device 18. The number of SSL devices 18 can be even or odd. The SSL devices 18 can for example be semiconductor light emitting diodes, organic light emitting diodes, polymer light emitting diodes or laser diodes. All of the SSL devices 18 may be configured to emit light of the same color, for example white light. Alternatively, different SSL devices 18 may be configured to emit light of different colors. The retrofit light bulb 1 may for example have red, green and blue SSL devices 18. All of the SSL devices 18 are arranged to emit light in a direction away from the connector 17. Both of the protruding portions 9, 10 receive light directly from each SSL device 18. Both protruding portions 9, 10 are thus illuminated by every SSL device 18. The SSL devices 18 are mounted on a carrier 19 extending perpendicular to the heat spreader 2. The carrier 19 is flat and has electrical connections for the SSL devices 18, the carrier 19 typically being a printed circuit board. In other embodiments, the carrier 19 may or may not be flat. The carrier 19 may be arched or V-shaped, for instance. A connection member 20 mechanically and electrically connects the carrier 18 to a driver board 21 for driving the SSL devices 18. The connection member 20 may be formed in one piece with the driver board 21 or formed as a separate part which is attached to the driver board 21. The connection member 20 can for example be a foil or one or more wires. Drive circuitry 22 is arranged on the driver board 21. The driver board 21 is arranged coplanar with the heat sink 2. A portion of the driver board 21 extends into the connector 17. In other embodiments, the driver board 21 may be arranged perpendicular to the optical axis OA and/or completely outside of the connector 17.

The carrier 19 is in thermal contact with the supporting surface 6 and the heat generated by the SSL devices 18 will be transferred via the supporting surface 6 to the heat spreader 2, and to the ambient via the first and second cover members 7,8.

The retrofit light bulb 1 is put in operation by plugging the connector 17 into an electrical socket connected to an electricity supply, whereby the driver board 21 supplies power to the SSL devices 18 via the connection member 20 and the carrier 19. The SSL devices 18 emit light into the compartment 11 which functions as a light mixing chamber where the emitted light mixes before exiting through the first and second cover members 7, 8. Some of the light emitted by the SSL devices 18 strikes the reflective surfaces 12, 13 and is reflected back into the compartment 11 before exiting. The light leaving through the first and second cover members 7, 8 makes up the illumination provided by the retrofit light bulb 1. The heat that is generated during the operation of the retrofit light bulb 1 is transferred to the ambient air via the heat spreader 2 and the first and second cover members 7, 8.

The person skilled in the art realizes that the present invention by no means is limited to the preferred embodiments described above. On the contrary, many modifications and variations are possible within the scope of the appended claims. For example, the connector 17 can be integrated with the first and second cover members 7, 8. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A retrofit light bulb having an optical axis, the retrofit light bulb comprising:

a substantially flat heat spreader having an opening, wherein said flat heat spreader is arranged along the optical axis and comprises a first side surface and a second side surface, parallel to each other with a normal perpendicular to the optical axis;

a supporting surface connected to the heat spreader, the support surface extending through the opening and protruding through the first and second surfaces of the heat spreader;

first and second cover members interposing the heat spreader, each cover member having a protruding portion directed away from the heat spreader and aligned with the opening, the two protruding portions together forming a compartment; and one or more solid state lighting devices mounted on a carrier arranged in said compartment, and in thermal contact with the heat spreader through the supporting surface, wherein said one or more solid state lighting devices are arranged so that each protruding portion receives light directly from each solid state lighting device.

2. The retrofit light bulb according to claim 1, wherein the first cover member facing the first side surface, and the second cover member facing the second side surface.

3. The retrofit light bulb according to claim 1, wherein the opening contains an optical center of the retrofit light bulb.

4. The retrofit light bulb according to claim 1, wherein said supporting surface has normal parallel to the optical axis which runs through a center point of the supporting surface.

5. The retrofit light bulb according to claim 1, wherein each protruding portion has a cross section parallel to the heat spreader, the size of the cross section being larger than or equal to the opening.

6. The retrofit light bulb according to claim 1, wherein the first and second cover members have substantially the same shape.

7. The retrofit light bulb according to claim 1, wherein each cover member has a flat portion at least partially surrounding the protruding portion.

8. The retrofit light bulb according to claim 1, further comprising a mechanical and electrical connector arranged by an end of the retrofit light bulb, each solid state lighting device being arranged to emit light in a direction away from the connector.

9. The retrofit light bulb according to claim 8, wherein the protruding portions extend beyond the opening in a direction towards the connector.

10. The retrofit light bulb according to claim 8, wherein an end of each protruding portion is provided with a reflector, the end being distal to the connector.

11. The retrofit light bulb according to claim 1, further comprising drive circuitry arranged on a driver board arranged coplanar with the heat spreader, the carrier being mechanically and electrically connected to the driver board by a connection member.

* * * * *